United States Patent [19]

Carr

[11] Patent Number: 4,515,206

[45] Date of Patent: May 7, 1985

[54] ACTIVE REGULATION OF HEAT TRANSFER

[75] Inventor: Edward F. Carr, Orono, Me.

[73] Assignee: Board of Trustees of the University of Maine, Bangor, Me.

[21] Appl. No.: 573,140

[22] Filed: Jan. 24, 1984

[51] Int. Cl.[3] ..... F28F 13/16

[52] U.S. Cl. ..... 165/1; 165/96; 165/104.28

[58] Field of Search ..... 165/1, 32, 96, 104.28

[56] References Cited

U.S. PATENT DOCUMENTS

| | | | |
|---|---|---|---|
| 2,748,356 | 5/1956 | Kaehni | 165/1 |
| 3,056,587 | 10/1962 | Steigerwald | 165/1 |
| 3,448,791 | 6/1969 | Clark | 165/96 |

OTHER PUBLICATIONS

Domains Due to Electric and Magnetic Fields in Bulk Samples of Liquid Crystals, Liquid Crystal and Ordered Fluids, vol. 3, (1978), E. F. Carr.

Surface Deformation and Walls in the Conduction Regime of Nematic Liquid Crystals, Molecular Crystals and Liquid Crystals, vol. 64, pp. 299-304, (1981), R. W. H. Kozlowski and E. F. Carr.

*Primary Examiner*—Albert W. Davis, Jr.

*Attorney, Agent, or Firm*—Daniel H. Kane, Jr.

[57] ABSTRACT

Method and apparatus are described for regulating the transfer of heat between a first element and second element by interposing a fluid layer of mesomorphic phase liquid crystal material between the elements and thermally coupling the elements through the fluid layer, and by applying an electric field across the fluid layer of liquid crystal material. The electric field actively controls and regulates heat transfer according to either a first mode by reorienting the director of the liquid crystal material and therefore switching the thermal conductivity, or by a second mode electrically inducing convection current flow cells for increasing heat transfer between the elements by a factor as great as 10 or more.

24 Claims, 10 Drawing Figures

ACTIVE REGULATION OF HEAT TRANSFER

TECHNICAL FIELD

This invention relates to a new method and apparatus for actively regulating heat transfer between a first body and a second body. The invention is applicable in a variety of fields, for example, temperature control of instrumentation, thermal switches and thermal logic gates, and generally the control of heat transfer, heat flow and thermal conductivity between elements.

BACKGROUND ART

Over many years of research in the field of liquid crystals, the present inventor, Professor Edward F. Carr of the University of Maine, has documented the occurrence of anamolous ordering and alignment effects of liquid crystal fluids in the presence of electric and magnetic fields, constructed models of the ordering and alignment effects, and provided explanations for these effects which have their origin in the conductivity and dielectric anisotropy characteristic of mesomorphic phase materials. In the chapter entitled "Domains Due to Electric and Magnetic Fields in Bulk Samples of Liquid Crystals", *Liquid Crystal and Ordered Fluids,* Vol. 3, edited by Johnson & Porter, Plenum Publishing Corporation (1978), the present inventor describes the occurrence of ordered domains separated by walls constituting defects in a nematic liquid crystal fluid when fields are applied perpendicular to the nematic director. The author proposed that an electric field applied across the fluid interacts with space charge associated with the conductivity anisotropy of the fluid to produce shear flow. This shear flow forms the walls which are a special type of defect in the molecular alignment separating the domains. Because of the shear flow the director associated with the liquid crystal fluid is turned toward the electric field.

Liquid crystals or liquid crystal fluids are mesomorphic phase materials exhibiting characteristics intermediate between crystalline solids and true amorphous liquids. Liquid crystals are usually composed of strongly elongated molecules with a tendency toward ordering and alignment of the molecules characteristic of solid crystals but retaining relative motion and flow between the molecules. Liquid crystals generally fall into three categories according to the characteristic modes of self ordering of the molecules, nematic, smectic, and cholesteric. Where the liquid crystal material is characterized by self alignment orientation of the elongate axis molecules, the alignment orientation along the elongate axes is referred to as the director.

Liquid crystal fluids and materials retain their mesomorphic phase characteristics up to a clearing point temperature or transition temperature at which the fluid undergoes a transition to a normal liquid phase. Below the clearing point temperature or transition point temperature, however, the liquid crystal fluid typically exhibits dielectric anisotropy, electrical conductivity anisotrophy, and is expected to exhibit thermal conductivity anisotropy in different directions relative to the orientation of the director. The extent of anisotropy in liquid crystal fluids varies over a range from weak to strong according to the particular materials. Mixtures of different liquid crystal materials are typically combined to provide a liquid crystal fluid of desired characteristics and such mixtures are available from commercial sources such as Merck Liquid Crystal Mixtures, EM Chemicals, P.O. Box 8500, Philadelphia, PA 19178.

In the article "Surface Deformation and Walls in the Conduction Regime of Nematic Liquid Crystals", *Molecular Crystals and Liquid Crystals,* Vol. 64 letters), pp. 299–304, Gordon and Breach Science Publishers, Inc. (1981), the present inventor with Kozlowski further documented that the anamolous ordered domains occurring in liquid crystal fluids in the presence of an electric field constitute flow cells driven by the shear flow in turn resulting from interaction between the electric field and the characteristic conductivity and dielectric anisotropy of the fluid. The volume of fluid in each domain or flow cell makes many rotations while the walls appear stationary though the material of which they are composed is constantly changing and moving with the maximum fluid velocity. Observations of the movement of dust particles with a microscope at the air-to-liquid crystal interface clearly show that there are flow cells as indicated. These observations were made using a special sample cell open at the top and with vertical electrodes.

OBJECTS OF THE INVENTION

It is therefore an object of the present invention to provide novel application of the ordering effects in mesomorphic phase liquid crystal fluids for active control and regulation of heat flow between a first body and a second body.

Another object of the invention is to provide active regulation of heat transfer through electrically induced flow cells or electrically controlled heat transfer between first and second elements.

A further object of the invention is to provide application of ordering effects of liquid crystal fluids in the presence of electric fields for temperature control of instrumentation, and for thermal switches and gates.

DISCLOSURE OF THE INVENTION

In order to accomplish these results the present invention provides a new apparatus for regulating heat transfer between a first body and a second body in the form of a fluid layer of mesomorphic phase liquid crystal material interposed between and thermally coupling the first body and the second body. The invention further provides a potential source for establishing an electric field across the fluid layer for initiating and regulating ordering effects within the fluid layer to control heat transfer by electrically induced convection flows or by variation of thermal conductivity. Where the first body and second body are comprised of electrically conductive material, the invention contemplates establishing the electric field by applying a potential difference between the conductive elements functioning as electrodes. The first and second bodies are generally electrically and thermally isolated except for the fluid layer coupling and the electric field may be either a DC electric field or an AC electric field. The invention is applicable for both thin film fluid layers and bulk layers.

The invention therefore contemplates the method for actively regulating heat transfer between first and second elements by interposing a fluid layer of mesomorphic phase liquid crystal material between the elements and thermally coupling the elements through the fluid layer, maintaining the liquid crystal material in the mesomorphic phase below the clearing point temperature and applying an electric field across the fluid layer.

The invention contemplates two modes of operation. For regulating heat transfer between spaced apart elements by actively controlling the thermal conductivity, the invention provides the steps of initially orienting the director of the liquid crystal fluid in a direction parallel or perpendicular to the fluid layer which is parallel to the spaced apart first and second elements and then applying an electric field across the fluid layer perpendicular to the spaced apart first and second elements for changing the orientation of the director of the liquid crystal material by approximately 90°. The liquid crystal material is selected to exhibit dielectric anisotropy so that the thermal conductivity between the spaced apart elements may be switched by reorienting the director with the applied electric field.

According to the second mode of the invention, heat transfer between spaced apart elements is regulated by applying an electric field across the fluid layer in the direction generally perpendicular to the spaced apart elements of sufficient intensity to establish electrically induced flow cells between the elements thereby substantially accelerating heat transfer by electrically induced convection currents between the spaced apart elements. According to the invention, the intensity of the electric field is sufficient to interact with space charges associated with the conductivity anisotropy of the liquid crystal material inducing shear flow along defects in the orientation alignment of the elongate axis molecules resulting in the electrically induced flow cells for rapid transfer of heat.

A feature and advantage of the second mode of regulation of heat transfer, according to the invention, is that heat transfer between the first and second bodies or first and second elements may be increased by a factor of approximately 10 or more as a result of the electrically induced convection flow cells in the liquid crystal fluid. Varying the intensity of the electric field applied across the fluid layer varies the rate of mass flow and therefore varies the rate of heat transfer by the flow cells.

The invention contemplates a variety of applications for the method and apparatus for active regulation of heat transfer including temperature control of instrumentation and thermal switches and gates. Other objects, features, and advantages of the invention are apparent in the following specification and accompanying drawings.

DESCRIPTION OF PREFERRED EXAMPLE EMBODIMENTS AND BEST MODE OF THE INVENTION

Figure 1:
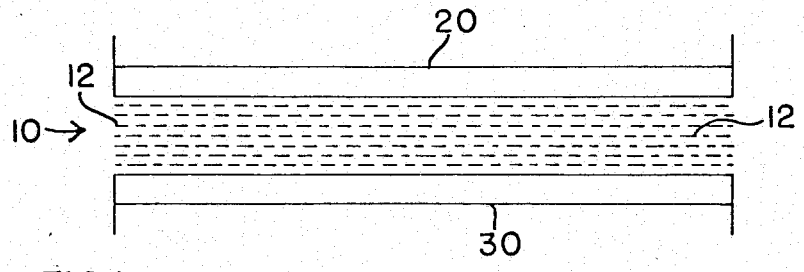
FIGS. 1, 2, and 3 are diagrammatic views of the apparatus and method for regulating heat transfer by control of thermal conductivity according to the first mode of the invention.
Figure 2:
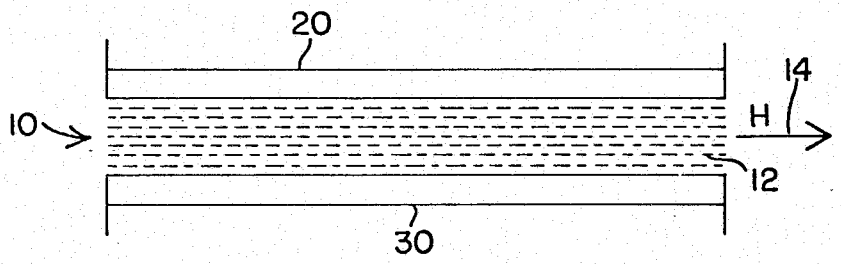
Figure 3:
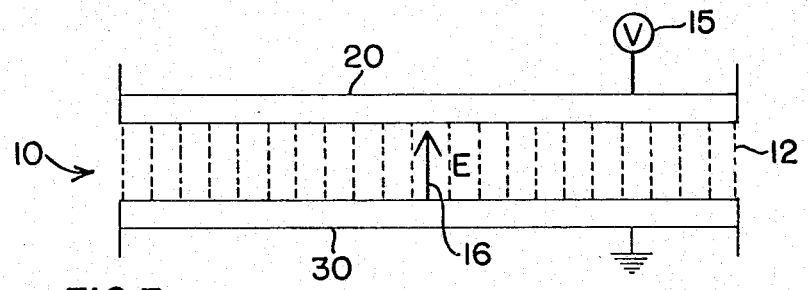

In the apparatus and method for controlling heat transfer according to the invention illustrated in FIGS. 1 through 3 a fluid layer 10 of liquid crystal material such as, for example, a nematic liquid crystal mixture is contained between the first and second bodies or elements 20, 30 in this instance parallel metal plates which function also as electrodes as hereafter described. For a thin film or thin sample fluid layer 10, the fluid layer may be in the order of 10 to 100$\mu$ (microns) thickness while for a bulk sample fluid layer, the fluid layer 10 may be up to, for example, 0.5 cm or more in thickness. The liquid crystal material composing the fluid layer 10 is characterized by strongly elongated molecules whose axes become oriented parallel to the surfaces of the plates 20 and 30 as shown diagrammatically by the dashed lines 12 of FIG. 1. This alignment orientation of the elongate axes of the molecules parallel with the adjacent surfaces results from molecular forces sometimes referred to as the "wall effect". Thus, without further influence the molecules of the liquid crystal establish a common alignment orientation, referred to as the director, parallel with each other and parallel to the adjacent confining surfaces.

The common alignment orientation of the director shown in FIG. 1 occurs more rapidly in a thin film or thin fluid layer than in a bulk sample layer although the directional forces of wall alignment will also orient the thicker bulk layers given enough time and absence of thermal gradiants. To enhance the initial alignment orientation of the director of the nematic liquid crystal mixture parallel with the surfaces of the confining plates, a magnetic field H may be applied in the direction of the vector arrow 14.

In the steps according to the invention illustrated in FIGS. 1 and 2, the directional forces of wall alignment and the applied magnetic field establish the director or common alignment orientation of the elongate molecule axes so that the thermal conductivity between the first element or plate 20 and second element or plate 30 is at a minimum or maximum for the particular liquid crystal material selected. To change the heat transfer between plates 20 and 30 by controlling the thermal conductivity of fluid layer 10 an electric field E is applied across the plates in the direction of arrow 16 by applying a potential difference from voltage source 15 between the plates. For a low voltage, for example in the range of 1 to 50 volts, the director of the liquid crystal material reorients so that the elongate molecular axes indicated by the dash lines 12 lie in the direction of the electric field E indicated by arrow 16. The reorientation of the director under the influence of an electric field is a result of the dielectric anisotropy of the liquid crystal material. The maximum dielectric constant occurs along the direction of the elongate axes of the molecules and the molecules seek alignment in an electric field so that the dielectric constant is a maximum. The larger the dielectric anisotropy of the selected liquid crystal material, the smaller the E field required to reorient the director perpendicular to the plates or elements 20 and 30. For positive dielectric anisotropy, as illustrated here, the dielectric constant is greatest parallel with the director and the direction preferred by the molecules is with the long axis or director parallel with the electric field E. For negative dielectric anisotropy the director orients perpendicular to the electric field E. Preferably the liquid crystal material is selected with strong dielectric anisotropy for operation according to the first mode of the invention.

Upon reorientation of the director of the fluid layer perpendicular to plates 20 and 30, the thermal conductivity changes therefore permitting a change in the heat transfer between the plates. The difference in thermal conductivity of fluid layer 10 according to the different orientations of FIGS. 2 and 3 is a function of the degree of thermal conductivity anisotropy of the selected liquid crystal material.

Liquid crystals with a negative dielectric anisotropy can also be used for the first mode of the invention. In this case the director would be initially aligned perpendicular to plates 20 and 30 due to a wall effect or other means such as using a magnetic field. An electric field of sufficient strength realigns the director parallel to plates 20 and 30 thus changing the thermal conductivity.

Although there are good measurements of the dielectric and electrical conductivity anisotropy on many liquid crystals, the thermal conductivity has not been thoroughly investigated. In an article entitled "Orientation of Liquid Crystals by Heat Conduction" by Stewart, Holland and Reynolds, it is reported that a temperature gradient produces molecular alignment in a nematic liquid crystal. The work reported in this article and an earlier article by Stewart very carefully eliminated shear flow alignment and other effects. In view of these results and because other properties of liquid crystals are anisotropic it may reasonably be concluded that the thermal conductivity is also anisotropic.

In regulating heat transfer by control of thermal conductivity according to this first mode of the invention, the magnetic field H applied in the apparatus of FIG. 2 may be applied continuously to align the molecules even during application of the electric field E as shown in FIG. 3. In that event, E is selected to be sufficiently large, to overcome the effect of the magnetic field and reorient the molecules. The electric field E applied by voltage source 15 may be either a DC field or an AC field. An AC field has substantially the same effect as a DC field. In using an AC electric field, care must be taken to stay below the dispersion frequency range or region of the selected liquid crystal material where the dielectric properties of the liquid crystal change as a function of frequency. For most liquid crystal materials, restricting the frequency to below 1 MHz avoids the effects of this dispersion region.

There are also liquid crystals which exhibit a change in the dielectric anisotropy at a critical frequency and such frequency sensitive liquid crystals can be used for the first mode of the invention without relying on wall alignment or a magnetic field to initially orient the director. In an article entitled "Nematic Phenyl Benzoates in Electric Fields II, Instabilities Around the Frequency of Dielectric Isotropy", *Molecular Crystals and Liquid Crystals,* Vol. 26, pp 235–243 (1973), de Jeu and Lathouwers investigated liquid crystals exhibiting a critical frequency for dielectric anisotropy. It is inferred that the thermal conductivity is also anisotropic for these particular materials. For these materials with a critical frequency associated with the dielectric anisotropy, the thermal conductivity is changed by applying electric fields with frequencies above or below the critical frequency depending on which direction is desired for the director (parallel or perpendicular to the electrodes).

Figure 4A:
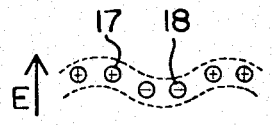
FIGS. 4A, 4B and 4C are diagrammatic views of the interaction of an electric field with space charges in the liquid crystal fluid layer showing the development of shear flow leading to domains or flow cells for regulation of heat transfer according to the second mode of the invention.
Figure 4B:
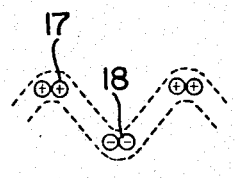
Figure 4C:
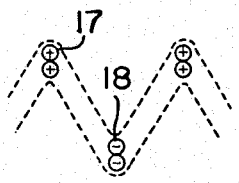
Figure 5:
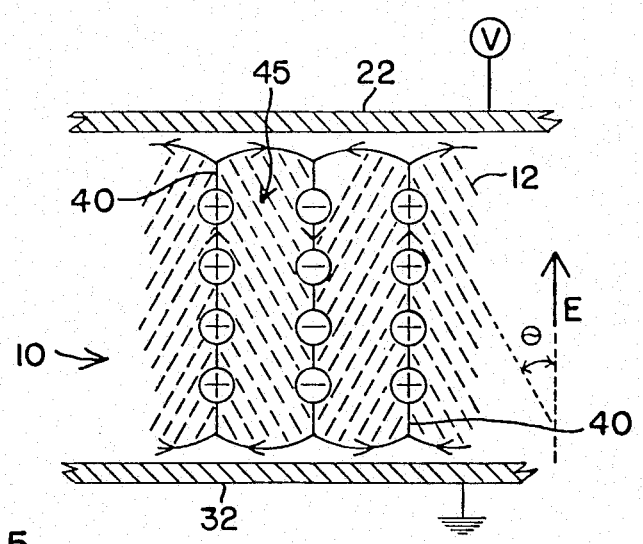
FIG. 5 is a diagrammatic view of the method and apparatus for regulation of heat transfer by controlling electrically induced convection flow cells or domains in the liquid crystal fluid layer.

Considering the second mode of operation of the invention, because of fluctuations in the molecular alignment, the electric field interacts with space charges 17 and 18 associated with the conductivity anisotropy of the liquid crystal material as shown diagrammatically in FIG. 4A. The continuing interaction of the field with the space charges develops shear flow in alternately opposite directions as shown diagrammatically in FIGS. 4B and 4C. Ultimately, as shown in FIG. 5, so-called "walls" or defects 40 form at the lines of maximum velocity in alternately opposite directions. The walls 40 delineate so-called domains or flow cells 45 of circular material flow between spaced apart elements or plates 22 and 32 as shown in FIG. 5. The circular flow in the flow cells 45 is parallel to the plates or electrodes 22, 32 near the surface of the plates and perpendicular to the plates along the walls 40.

Figure 6:
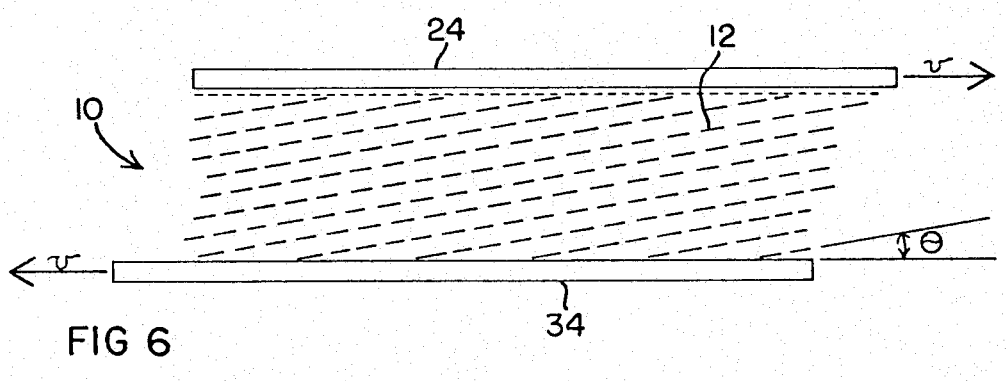
FIG. 6 is a diagrammatic view of apparatus demonstrating the phenomenon of flow alignment of the liquid crystal material director as a result of shear flow.

As a result of the shear flow along the walls 40, the director associated with the liquid crystal fluid between the walls is turned toward the electric field by the phenomenon of flow alignment. As illustrated by the physical example of FIG. 6, if two plates 24, 34 with an intermediate liquid crystal fluid layer 10 are translated relative to each other at a velocity v, the director or common alignment orientation of the elongate axes of the molecules indicated by dash lines 12 is reoriented from the horizontal direction parallel with plates 24, 34 at an angle $\theta$. Similarly, as shown in FIG. 5, the director or common alignment orientation of the elongate axes of the molecules represented by dash lines 12 are reoriented by an angle $\theta$ from the perpendicular direction established by the electric field E but in alternately opposite directions in successive alternate flow cells. Thus, the shear flow along the walls 40 results in an angle $\theta$ referred to as the "flow alignment angle". In an article entitled "NMR Evidence for an Ionic Conduction-Induced Flow Alignment Angle in Nematic Liquid Crystals", *Solid State Communications* Vol. 33, pp 459–462 Tarr and Carr showed that there is a flow alignment angle associated with the flow cells and measured this angle in the liquid crystal N-(p-methoxbenzylidene)-p-butylaline (MBBA) as a function of temperature.

More importantly, however, the mass movement within the electrically induced convection current flow cells 45 established between the elements or bodies 22, 32 can produce an increase in heat transfer by as much as a factor of approximately 10 or more over the heat transfer that otherwise obtains in the absence of electric field E. As shown in more detail in FIG. 7, the present inventor has found that the walls 45 being the loci of alternately opposite direction shear flow extend out from the electrodes to more than half the distance to the opposite electrode. The walls are thus comprised of fluid constantly changing and circulating in a pattern within each flow cell back and forth between the electrodes for efficient transfer of heat.

Figure 8:
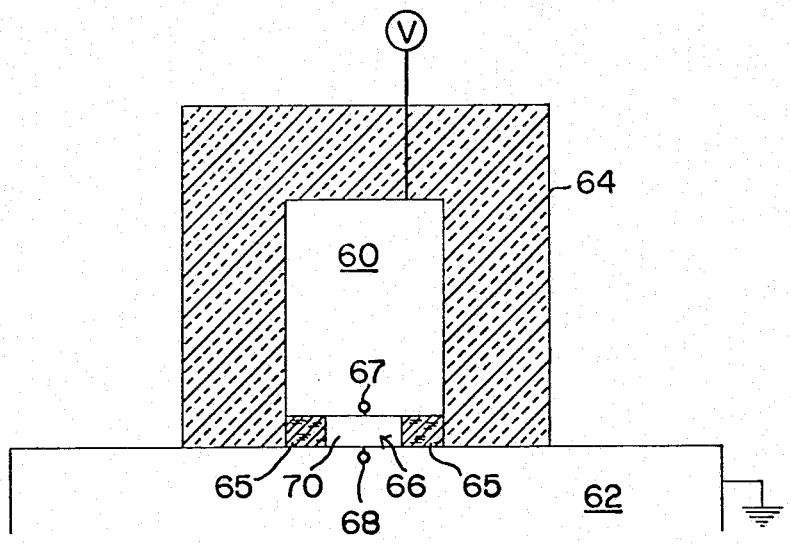
FIG. 8 is a diagrammatic side cross section view of apparatus for controlling heat transfer between a first body and a second body according to the invention.

A particular apparatus for regulation of heat transfer according to the invention is illustrated in FIG. 8. A copper block 60 representing a first body or element is substantially electrically and thermally isolated from the aluminum block 62 by styrofoam insulation 64 and cork insulating elements 65. The copper block 60 and aluminum block 62 are, however, thermally coupled through a cell 66 containing a fluid layer 70 of a liquid crystal such as, for example, a nematic liquid crystal. Thermocouples 67 and 68 are positioned on either side of the fluid layer cell 66 for measuring the temperature differential and rate of heat transfer between the copper block 60 and aluminum block 62. By way of an example and demonstration a copper block 60 having cross sectional area of 7.0 $cm^2$, and 6.5 cm high is heated to 70° C. before placing it in the insulating enclosures of the apparatus. The larger aluminum block 62 is maintained at a temperature of 22° C. The sample cell 70 may be, for example, in the range from 0.75 to 1.5 $cm^2$ and is filled with Merck nematic liquid crystal mixture 5A having a thickness of, for example, up to 0.15 to 0.2 cm. Other liquid crystal material such as, for example, MBBA may of course also be used.

Figure 7:
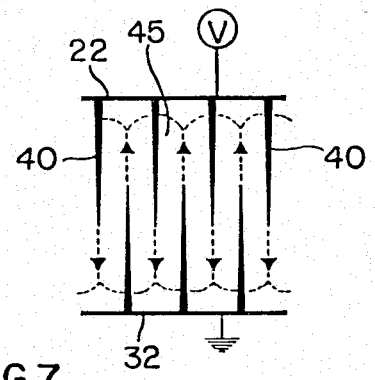
FIG. 7 is another diagrammatic view of the method and apparatus for regulating heat transfer by control of flow cells in the liquid crystal fluid layer according to the second mode of the invention.

An electric field intensity in the range of, for example 1 to 25 kV/cm DC electric field is applied across the parallel facing surfaces of copper block 60 and aluminum block 62 for developing flow cells of the type illustrated in FIGS. 5 and 7. Measurements of heat transfer during cooling of the copper block to a temperature of approximately 30° C. indicate controlled increase of heat transfer between the copper block 60 and aluminum block 62 by a factor in the order of approximately 10 in the presence of the electric field. Further description of the performance of the apparatus of FIG. 8 can be found in the article by the inventor entitled "Regulation of Heat Transfer Using Liquid Crystals in the Presence of Electric Fields" published in the *Molecular Crystal and Liquid Crystal Letters,* Vol. 92, No. 6, pp. 165–170, (October 1983), copy submitted with this patent application.

Either DC or AC electric fields can be used for the second mode of operation according to the invention. However, for AC fields, the frequency $f_o$ is selected below the space charge relaxation frequency i.e., $f_o < 1/\tau$, where $\tau \cong$ space charge relaxation time.

Suitable liquid crystal materials for use in the present invention are available for a variety of temperature ranges in the regulation and control of heat transfer. A further discussion of the characteristics of liquid crystals can be found in P. G. de Gennes, *The Physics of Liquid Crystals,* Clarendon Press, Oxford (1974). The mesomorphic phase necessary for the method and apparatus of the present invention may be maintained over a wide range in certain mixtures. The best mesomorphic phase liquid crystal materials and mixtures presently available are the nematic mixtures which maintain the mesomorphic phase for temperatures in the range of from −25° C. to up to 88° C. At the lower limit of −20° C. to −25° C. the liquid crystal material starts solidifying while at the upper limit the liquid crystal material begins undergoing transition to a regular liquid. The mesomorphic phase may be maintained in some liquid crystal materials such as anasaldazine at temperatures as high as 168° C. to 180° C. but at such high temperatures, even though below the "clearing point" there may be problems of decomposition. In any event, the liquid crystal mixture or pure material would be selected for operation as a mesomorphic phase material within the temperature ranges within which the heat transfer is to be regulated and controlled.

Other liquid crystal material such as PAA and MBBA retain the mesomorphic phase over a much smaller temperature range. The broadest ranges are apparently achieved in the liquid crystal mixtures, for example, the Merck LICRISTAL (TM) mixtures such as mixture ZLI-1831 (TM) and mixture 5A. While liquid crystal material having strong dielectric anisotropy, either positive or negative, is selected for operation according to the first mode of the invention, for active regulation and control of heat transfer by establishing flow cells according to the second mode of operation of the invention, liquid crystal materials exhibiting weak dielectric anisotropy are selected. Furthermore, according to the preferred method and apparatus of the present invention, mesomorphic phase liquid crystal materials having weak negative dielectric anisotropy are preferred. Such mesomorphic phase liquids with weak dielectric anisotropy include by way of example, the Merck liquid crystal mixture 5A referred to above and such liquid crystals as PAA and MBBA. The establishment of flow cells with wall defects may be achieved with liquid crystal materials having weak positive dielectric anisotropy, however the development is more fully achieved and operation according to the second mode of the invention preferred with liquid crystals exhibiting weak negative dielectric anisotropy.

Certain liquid crystal mixtures may be prepared to yield the characteristics of both strong and weak dielectric anisotropy. For such liquid mixtures it may be possible to achieve active regulation and control of heat transfer using the methods and apparatus of the present invention according to both the first and second modes of operation. For example, for low amplitude or low intensity control of heat transfer, the first mode of operation may be selected while for greater amplitude or intensity of heat transfer, a greater electric field intensity may be applied to accentuate the second mode of operation according to the invention. Preferably, a liquid crystal material is selected with strong dielectric anisotropy for operation according to the first mode of the invention, permitting regulation and control of heat transfer according to the invention using smaller electric fields. Strong positive dielectric anisotropy is preferred according to the invention with alignment of the director and the long axis of the molecules in the preferred direction parallel with the electric field.

It has been noted that for liquid crystal materials characterized by small negative dielectric anisotropy, electric field intensities over a wide range may be used for establishing flow cells for active control of heat transfer. For example, flow cells bounded by wall defects have been developed in a mesomorphic phase liquid crystal layer, for example, 1 to 2 mm thick by application across the layer of an electric field intensity as low as 100 volts/cm and even slightly lower. On the other hand, the experiments described above rapidly developed flow cells bounded by wall defects with application of electric fields of 25 kV/cm and greater. With an electric field intensity of 25 kV/cm, the heat transfer between the first and second elements, bodies or electrodes may be amplified or multiplied by a factor of 10 and more. It is anticipated that electric field intensities as great as 50 kV/cm and greater may be applied. The data indicate that the velocity of the mesomorphic phase liquid crystal fluid in the flow cells established between the electrodes or elements varies roughly as the square of the applied electric field intensity E. Thus, heat transfer may be actively regulated or controlled over a wide range of parameters and a wide range of heat transfer values by application of electric field intensities according to the second mode of operation of the invention from as low as 50 to 100 volts/cm to as high as 25 to 50 kV/cm. In the middle of this range the experimental data indicates that heat transfer and heat flow may be amplified by a factor of about 10 and more over heat transfer in the absence of the applied electric field.

Even at lower electric field intensities, a voltage effect is noted distorting the liquid crystal layer as a result of its dielectric anisotropy and electrical conductivity anisotropy. Thus, at 10 volts applied across a thin sample there is distortion of the director without the development of wall defects, while at 50 volts the development of wall defects can be identified.

A feature and advantage of the present invention is that the transfer of heat between bodies or elements may be modulated in time by regulation and control of the ordering effects in the fluid layer of liquid crystal material. Furthermore, the rate of heat transfer may be modulated in space across the surface areas of the elements or bodies by the application of different potential differences and field intensities at different locations across the surface areas coupled by the fluid layer.

Another feature of the present invention is the low power requirement. For operation according to the second mode of the invention with a sample thickness of approximately 1 mm and a cross-sectional area of 1 $cm^2$, the power requirement is less than 1 milliwatt in the presence of a field of 10,000 volts/cm. The power requirement for the first mode of operation according to the invention is comparable to the power requirements of an L.C.D. watch.

The invention has application to a variety of industrial fields including, for example, the temperature control of aircraft and space instruments, the temperature stabilization of underground instruments and electronic components such as, for example, are used in bore hole logging systems described in U.S. Pat. No. 3,379,032, and in thermal switches and thermal logic gates of the type, for example, described in U.S. Pat. No. 4,137,964. The invention may assume a variety of configurations according to the application and use. For example, for temperature control of instruments the first body may comprise an inner body, the second body an outer body enclosing the inner body, with the mesomorphic phase fluid layer filling the space in between. Furthermore, the mesomorphic phase liquid may comprise nematic, smectic, or cholesteric liquid crystal material.

While the invention is described with reference to particular example embodiments, it is intended to cover all variations and equivalents within the scope of the following claims.

I claim:

1. Apparatus for regulating heat transfer between a first body and a second body comprising:

a fluid layer of mesomorphic phase liquid crystal material interposed between and thermally coupling the first body and the second body; and means for establishing an electric field across the fluid layer.

2. The apparatus of claim 1 wherein the first body and the second body are comprised of electrically conductive material and wherein the means for establishing an electrical field across the fluid layer comprises means for establishing a potential difference between the first body and the second body.

3. The apparatus of claim 2 wherein the first body and the second body comprise approximately parallel spaced apart electrodes, wherein the fluid layer fills the space between the electrodes, and wherein the means for establishing an electric field across the fluid layer comprises means for establishing a potential difference between the electrodes.

4. The apparatus of claim 2 wherein the first body comprises an inner body and wherein the second body comprises an outer body substantially enclosing and surrounding the first body, and wherein the fluid layer substantially fills the space between the first body and the second body.

5. The apparatus of claim 1 wherein the first body and second body are substantially electrically and thermally isolated except for the fluuid layer.

6. The apparatus of claim 1 wherein the means for establishing an electric field across the fluid layer comprises means for establishing a DC electrical field.

7. The apparatus of claim 1 wherein the means for establishing an electric field across the fluid layer comprises means for establishing an AC electric field.

8. The apparatus of claim 1 wherein the electric field comprises an electric field intensity of from approximately 50 to 50,000 volts/cm.

9. Apparatus of claim 1 wherein the liquid crystal material comprises nematic liquid crystal material.

10. The apparatus of claim 1 wherein said fluid layer of mesomorphic phase liquid crystal material comprises a thin layer in the order of 100 microns or less.

11. The apparatus of claim 1 wherein said fluid layer of mesomorphic phase liquid crystal material comprises a bulk layer.

12. A thermal gate for switching and controlling heat transfer between a first element and a second element comprising:

a fluid layer of mesomorphic phase liquid crystal material interposed between and thermally coupling the first element and the second element;

electric field means for establishing an electric field across the fluid layer;

switch means for controlling said electric field means;

bias field means for applying a bias field along the fluid layer for ordering the molecules of the liquid crystal material;

said electric field means constructed and arranged for applying an electric field across the fluid layer to overcome the ordering effect of the bias field applied along the layer.

13. The thermal gate or switch of claim 12 wherein the bias field means comprises means for establishing a biasing magnetic field.

14. A method for regulating the transfer of heat between a first body and a second body comprising:

interposing a fluid layer of mesomorphic phase liquid crystal material between the first body and the second body and thermally coupling the first body and second body through the fluid layer;

maintaining the liquid crystal material in the mesomorphic phase below the clearing point temperature or transition temperature of the liquid crystal material;

applying an electric field across the fluid layer of liquid crystal material between the first body and the second body thereby establishing flow cells in the liquid crystal material for accelerating heat transfer between the first body and the second body;

and varying the strength of the electric field for varying the rate of heat transfer between the first body and the second body.

15. The method of claim 14 wherein the mesomorphic phase liquid crystal material is characterized by weak negative dielectric anisotropy.

16. A method for regulating heat transfer between spaced apart first and second elements comprising:

thermally coupling the first and second elements by interposing a fluid layer of mesomorphic phase liquid crystal material between the spaced apart first and second elements, said liquid crystal material characterized by elongate axis molecules and generally common alignment orientation of the elongate axes referred to as the director;

maintaining the liquid crystal material in the mesomorphic phase below the clearing point temperature or transition temperature of the liquid crystal material;

initially orienting the director of the liquid crystal material in a direction parallel or perpendicular to the fluid layer and the spaced apart first and second elements;

applying an electric field across the fluid layer perpendicular to the spaced apart first and second elements for changing the orientation of the director of the liquid crystal material;

said liquid crystal material selected to exhibit dielectric anisotropy whereby the thermal conductivity between the spaced apart first and second elements may be switched between a lower thermal conductivity and a higher thermal conductivity by reorienting the director with said applied electric field.

17. The method of claim 16 comprising the step of initially orienting the director of the liquid crystal material along the fluid layer generally parallel to the spaced apart first and second elements by applying a bias field in the direction along the fluid layer generally parallel to the spaced apart first and second elements.

18. The method of claim 17 wherein said bias field comprises a magnetic field.

19. The method of claim 17 wherein the step of applying a bias field comprises continuously applying said bias field while applying said electric field and wherein the step of applying the electric field comprises applying an electric field of sufficient intensity to overcome the bias field and reorient the director of the liquid crystal material toward the direction across the fluid layer perpendicular to the spaced apart first and second elements thereby switching the thermal conductivity of the fluid layer between the spaced apart first and second elements.

20. The method of claim 16 further comprising the step of applying an electric field across the fluid layer in the direction generally perpendicular to the spaced apart first and second elements of sufficient intensity to establish electrically induced flow cells between the spaced apart first and second elements thereby substantially accelerating heat transfer by electrically induced convection currents between the spaced apart first and second elements.

21. The method of claim 16 wherein the liquid crystal material is characterized by strong dielectric anisotropy.

22. The method of claim 16 wherein the fluid layer of liquid crystal material comprises a thin layer in the range of up to 100 microns.

23. The method of claim 16 wherein the fluid layer of liquid crystal material comprises a bulk layer.

24. The method of claim 15 wherein the step of applying an electric field comprises applying across the electrodes a field intensity up to 50,000 volts/cm.

* * * * *